US010971828B2

(12) United States Patent
Acien Fernández

(10) Patent No.: US 10,971,828 B2
(45) Date of Patent: Apr. 6, 2021

(54) INSULATION-DISPLACEMENT CONNECTOR

(71) Applicant: SIMON, S.A.U., Barcelona (ES)

(72) Inventor: Jonatan Acien Fernández, Barcelona (ES)

(73) Assignee: SIMON, S.A.U., Barcelona (ES)

( * ) Notice: Subject to any disclaimer, the term of this patent is extended or adjusted under 35 U.S.C. 154(b) by 200 days.

(21) Appl. No.: 16/305,794

(22) PCT Filed: Jun. 5, 2017

(86) PCT No.: PCT/ES2017/070405
§ 371 (c)(1),
(2) Date: Nov. 29, 2018

(87) PCT Pub. No.: WO2017/212097
PCT Pub. Date: Dec. 14, 2017

(65) Prior Publication Data

US 2020/0328537 A1 Oct. 15, 2020

(30) Foreign Application Priority Data

Jun. 6, 2016 (ES) ..... ES201630760

(51) Int. Cl.
*H01R 4/2441* (2018.01)

(52) U.S. Cl.
CPC ..... *H01R 4/2441* (2013.01)

(58) Field of Classification Search
CPC ..... H01R 4/2441; H01R 4/24; H01R 4/2416; H01R 4/242; H01R 4/2455; H01R 4/2454;

(Continued)

(56) References Cited

U.S. PATENT DOCUMENTS 4,773,875 A 9/1988 Huiskes
5,522,733 A * 6/1996 White ..... H01R 4/2429 439/395

(Continued)

FOREIGN PATENT DOCUMENTS

CN 103825123 A 5/2014
DE 202014106002 U1 1/2015

(Continued)

OTHER PUBLICATIONS

Demand for International Preliminary Examination dated Apr. 5, 2018 re: Application No. PCT/ES2017/070405, pp. 1-10.

(Continued)

*Primary Examiner* — Travis S Chambers
(74) *Attorney, Agent, or Firm* — Cantor Colburn LLP

(57) ABSTRACT

An insulation-displacement connector including two cutting and connecting blades, each one provided with a section for inserting and centering of a cable, a cutting edge which extends from the section for centering and insertion, a base, and an arm for joining each blade to the base; where the cutting edges are inclined along the entire extension of the edges such that they cross one another, and where the cutting and connecting blades are not joined together at an end of the blades opposite to the joining end of the sections, but rather are joined to the arms such that the blades may be separated from one another according to a transverse direction.

9 Claims, 5 Drawing Sheets

(58) Field of Classification Search
CPC .... H01R 4/2456; H01R 4/245; H01R 4/2462; H01R 4/2437
USPC ..... 439/395, 397, 404, 405, 443
See application file for complete search history.

(56) References Cited

U.S. PATENT DOCUMENTS

| | | | | |
|---|---|---|---|---|
| 5,588,859 | A * | 12/1996 | Maurice | H01R 4/2425 439/290 |
| 5,622,516 | A * | 4/1997 | Baggett | H01R 4/2425 439/408 |
| 5,685,733 | A | 11/1997 | Janczak | |
| 5,836,782 | A * | 11/1998 | Odley | H01R 4/2425 439/397 |
| 5,911,593 | A | 6/1999 | Glaser et al. | |
| 5,997,336 | A | 12/1999 | Yamamoto et al. | |
| 6,036,527 | A | 3/2000 | White et al. | |
| 6,142,817 | A | 11/2000 | Lee | |
| 6,431,903 | B1 | 8/2002 | Dittmann et al. | |
| 6,527,580 | B1 * | 3/2003 | Suss | H01R 9/2625 439/417 |
| 2010/0009567 | A1 * | 1/2010 | Gyagang | H01R 4/2462 439/395 |
| 2011/0076898 | A1 | 3/2011 | Taniguchi | |
| 2011/0117769 | A1 | 5/2011 | Okamura | |
| 2012/0178315 | A1 * | 7/2012 | Knuttel | H01R 13/03 439/850 |
| 2013/0323988 | A1 | 12/2013 | Matoba | |
| 2016/0072200 | A1 * | 3/2016 | Sabo | H01R 4/2454 439/395 |

FOREIGN PATENT DOCUMENTS

| | | | |
|---|---|---|---|
| FR | 2819348 | A1 | 7/2002 |
| FR | 2921763 | A1 | 4/2009 |
| GB | 635943 | A | 4/1950 |
| GB | 2387040 | A | 10/2003 |
| JP | S59186967 | U | 12/1984 |
| JP | 2003045510 | A | 2/2003 |
| JP | 2014203568 | A | 10/2014 |
| JP | 2014212094 | A | 11/2014 |
| WO | 2010029392 | A1 | 3/2010 |

OTHER PUBLICATIONS

International Search Report dated Jan. 24, 2018 re: Application No. PCT/ES2017/070405, pp. 1-3.
Written Opinion dated Jan. 24, 2018 re: Application No. PCT/ES2017/070405, pp. 1-3.

* cited by examiner

INSULATION-DISPLACEMENT CONNECTOR

FIELD OF THE INVENTION

The present invention falls within the sector of insulation-displacement connectors, and more specifically those made up of a cut or punched and bent metal sheet, wherein said displacement and connection is done by inserting a cable between two blades.

BACKGROUND OF THE INVENTION

Insulation-displacement connectors, abbreviated as IDCs, of the type comprising two cutting and connecting blades, each one provided with a section for centering and inserting a cable and a cutting edge which extends from the section for centering and insertion, are known.

These are the basic parts of these connectors. They are used in the following way. First, the cable is pressed on the sections for centering and insertion of the blades, which define a concave housing between them, in the bottom of which there is an opening defined by the separation between the initial sections of the blades. Then, either manually or by means of a pressure lever belonging to a complementary part of the connector, such as a casing with multiple connections, the cable is pressed, arranged with the longitudinal axis of its core perpendicular to the plane of the blades, so that the blades sequentially make a cut in the cable sleeve; finally, it makes contact with an eventual plastic deformation of the metal core of the cable. As a result of the operation, an electrical contact is made between the connector and the cable core.

These connectors are completed with a support base, which will normally be the part intended to make contact with another conductor in order to conduct the current, and arms joining each blade to the base. This base usually houses a guide which guides the cable to the correct insertion position thereof, in front of the blade and a pressure lever of the cable.

There are many examples of these types of connectors, among which the following examples are noteworthy because of their similar characteristics to those of the present invention:

U.S. Pat. No. 6,431,903, US2012178315, JP2014212094, JP2014203568, WO10029392, US2011117769, JP2003045510, US2013323988, U.S. Pat. Nos. 6,142,817, 5,997,336, 4,773,875, CN103825123.

In these connectors, and when there are no stresses or deformations from the presence of a cable, the edges of the blades are parallel. The arrangement of the blades usually has them facing each other, joined at the lower part thereof, such that they are practically rigid, at least with regard to the rotation of the blades in the plane in which they are contained. This condition, and the fact that the diameter of the cable is greater than the separation between the blades, makes it so the force is not constant, and neither the depth of the cable lock nor the force exerted by the blades is correctly controlled, which is why tears easily occur, or that the locking forces are insufficient and hardly resist the tensile forces on the cable.

DE202014106002, US2011076898 or U.S. Pat. No. 5,685,733, for example, propose guaranteeing control of the force of the blades by making it possible for said blades to be able to pivot on points close to the section for centering and insertion, specifically by punching out the sheets, thereby making them "hang" from the lower ends of the aforementioned sections for centering and insertion. The resulting structure is weak, and furthermore, the force exerted by the blade decreases in accordance with the insertion direction, which is why the lock is unstable, unless the cable is inserted to the end. These solutions, therefore, do not offer control of the stable position of the cable.

U.S. Pat. No. 5,911,593 and JP59186967U describe connectors in which the distance between the blades decreases in the insertion direction of the cable, but the blades are joined at the lower part thereof, which is why by increasing the insertion depth between the blades, the cutting force substantially increases and may actually cut the cable, or weaken it.

In U.S. Pat. No. 6,036,527 the blades are not joined at the lower part thereof, at least not at the level of the edges, but rather the centers of rotation of the blades are somewhat separated from the lower ends of the blades. However, this design implies an increase in the force on the cable with the increase in depth.

FR 2819348 A1 discloses an insulation-displacement connector, which comprises two cutting and connecting blades, so that in absence of forces caused by the insertion of a cable between the blades, the cutting edges are inclined with respect to the insertion direction and throughout the entire extension of the edges, and the cutting and connecting blades are not joined together at an end of the blades opposite to the joining end with the centering and insertion sections, but rather are joined to the joining arms such that the blades may be separated from one another according to the transverse direction along the entire extension of the cutting edges.

DESCRIPTION OF THE INVENTION

In order to resolve the drawbacks of the state of the art, the present invention proposes an insulation-displacement connector comprising:

- two cutting and connecting blades, each one provided with:
  - a section for centering and inserting a cable; and
  - a cutting edge which extends from the section for centering and inserting the cable,
- a base; and
- an arm for joining each blade to the base;

thereby defining:

- an insertion direction between the blades;
- a transverse direction, perpendicular to the insertion direction, and which goes from one blade to another;
- a frontal direction perpendicular to the insertion and transverse directions, and which corresponds to the axis of the cable when the same is correctly inserted between the blades.

Said characteristics being known, according to the present invention, in the absence of stress caused by the insertion of the cable between the blades, the cutting edges are inclined with respect to the insertion direction and throughout the entire extension of the edges, the projections of the cutting edges on a plane defined by the insertion and transverse directions being secant at an intermediate point of the cutting edges, and the cutting and connecting blades not being joined together at an end of the blades opposite the joining end with the sections for centering and insertion, but instead being joined to the joining arms such that the blades may be separated from one another according to the transverse direction along the entire extension of the cutting edges.

This structure provides a solution for the drawbacks in the state of the art. By separating the arms along the entire extension thereof, and by an arrangement in which the edges are crossed, the desired relationship of the force and the depth may easily be obtained, meaning that is achieved the control of the cutting force along the extension of the cutting edges.

In particular, relating to the disclosed in FR 2819348 A1, which is considered the closet state of the art, a greater range of acceptable diameters. In the documents of the state of the art, and in particular in FR 2819348 A1, the blades are facing each other. Nevertheless, and as the inventors have found, it is not necessary to arrange the blades in the same plane for achieving an optimum operation of the IDC, but these blades can be disposed in different planes, in a way that a secant point is defined as claimed. In that way it is possible to have an effective IDC for a greater range of diameters.

In some embodiments, the connector is a punched and bent metal sheet.

In some embodiments, the base and the arms jointly define a U section, in other words, the section has a form which has two ends joined at the bottom, such that it forms an accessible cavity above. In this case, the bottom of the U is the base, the blades are joined to each arm at the upper part of the lateral edges of the arms and perpendicular to the same, such that a volume for receiving a cable is defined between the base, the arms and the lower edge of the blades.

This structure provides a relative arrangement of the arms, base and blades which allows for a movement of the blades by the elastic deformation of the arms, which allows them to separate throughout the entire length of the cutting edges, and therefore correctly adapt to the diameter of the cable.

In some embodiments, the sections for centering and insertion have the contour of a circular arc.

In some embodiments, the blades and the base form an angle comprised between 70° and 80°.

In some embodiments, the base is a section of sheet, bent in a U shape, the arms being extensions of the legs of the U, such that the arms are on parallel planes, the blades being extensions of the arms, the base being on the part opposite to the end of the blades opposite the end joining to the sections for centering and insertion.

In some embodiments, the arms are cut in a sheet according to a contour with the form of a circular arc on inner edges contiguous with the sections for centering and inserting a cable, such that an opening for the insertion of a cable is defined.

In some embodiments, the connector consists of a closed metal strip, having the form of a tubular section, made up of the base, the arms and the blades. Preferably, the section of the connector is made up of the base articulated to the arms by means of two curved sections, the other two ends of the arms being made up of semicircular sections followed by two curved sections which end at the blades.

BRIEF DESCRIPTION OF THE DRAWINGS

As a complement to the description, and for the purpose of helping to make the characteristics of the invention more readily understandable, in accordance with a practical embodiment thereof, said description is accompanied by a set of figures constituting an integral part thereof, which by way of illustration and not limitation represent the following:

FIGS. 4 to 7 are a front elevation view, a perspective view and a plan view, respectively, of the connector according to a second embodiment.

DESCRIPTION OF EMBODIMENTS OF THE INVENTION

Figure 1:
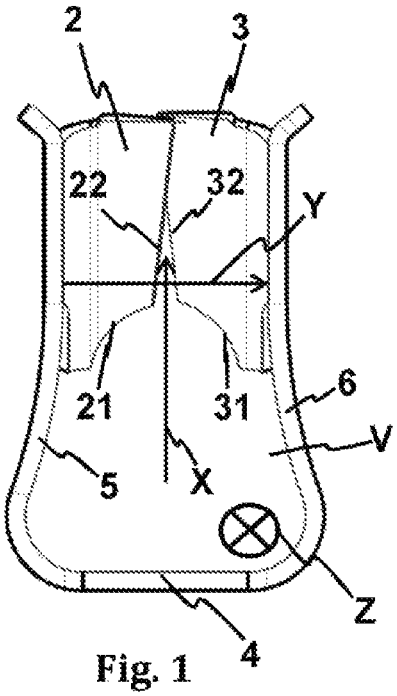
FIGS. 1 to 4 are a front elevation view, a side elevation view, a plan view and a perspective view, respectively, of the connector according to a first embodiment.

As shown in the figures, the present invention relates to an insulation-displacement connector 1 comprising:

- two cutting and connecting blades 2, 3 each one of which is provided with:
  - a section 21, 31 for centering and inserting a cable W; and
  - a cutting edge 22, 32 which extends to the section 21, 31 for centering and insertion;
- a base 4; and
- an arm 5, 6 for joining each blade 2, 3 to the base 4.

In all of the illustrated embodiments, the connector consists of a body obtained by cutting/punching a metal sheet, to which an additional stage of flatting and sharpening may be applied, in order to sharpen the cutting edges. The laminar nature of the connector provides elasticity to the arms, such that the blades may be separated when a cable is inserted between them. For very small IDCs, such as those with a cable thickness of less than 0.3 mm, it is not necessary to reduce the section of the blade.

Figure 5:
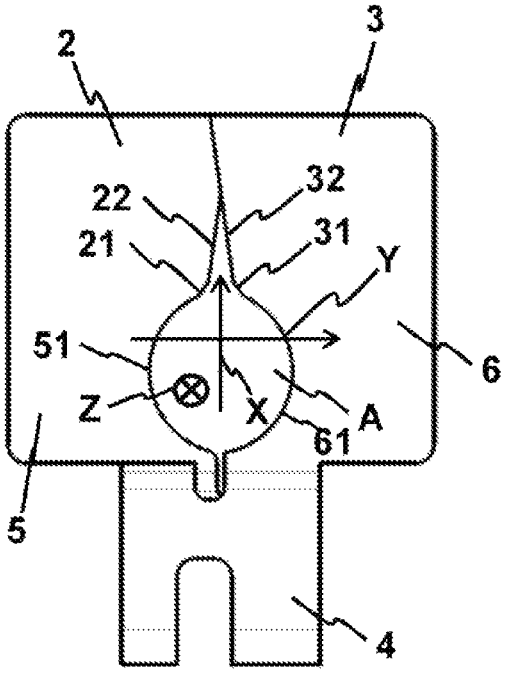

As shown in FIGS. 1 and 5, the presence of the mentioned components allows us to define the following reference, which will be useful to relate the connector characteristics:

- an insertion direction X between the blades 2, 3; if done correctly, in the different embodiments according to the invention, the sheathed cable is arranged in the section for centering and insertion at the height of the cable where the cutting and connection is desired to be done. Therefore, the insertion direction is that with respect to which the blades 2, 3 are symmetrical, and the insertion direction is that which goes from the section for centering and insertion to the cutting and contact edges,
- a transverse direction Y, perpendicular to the insertion direction and which goes from one blade 2 to another 3;
- a frontal direction Z perpendicular to the insertion X and transverse Y directions, and which corresponds to the axis of the cable W when the same is correctly inserted between the blades 2, 3.

FIGS. 1 to 10 show the different embodiments of the invention in a state of equilibrium in the absence of an inserted cable. The configuration in the absence of cable is different from the configuration with the cable inserted, which is why the invention is described and claimed in the absence of stress caused by the insertion of a cable between the blades 2, 3.

Figure 8:
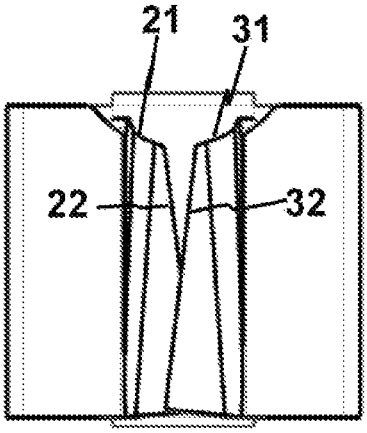
FIGS. 8 to 10 are a front view, a plan view and a perspective view, respectively, of the connector according to a third embodiment.

In these conditions, and as may be clearly seen in FIG. 1, 5 or 8, the cutting edges 22, 32, are inclined with respect to the insertion direction X along the entire extension of the edges 22, 32.

The inclination is not just any inclination, but rather one in which the projections of the cutting edges 22, 32 on a plane defined by the insertion X and transverse Y directions are secant at an intermediate point of the cutting edges 22, 32. In other words, although in some embodiments it may be possible that the cutting edges 22, 32 in the absence of cable really are secant, such as in FIG. 10, in a more general way, according to the invention, these edges cross when the connector is seen from the front. In practice, given the minimum separation necessary between the edges to be able to cut the cable sleeve, it may be supposed that they indeed cut, as occurs with scissors.

To completely define the invention, this characteristic is complemented by the fact that the cutting and connecting blades 2, 3 are not joined to one another at an end of the blades 2, 3 opposite the end joining to the sections 21, 31, as happens in known connectors, but rather are joined to the joining arms 5, 6 such that the blades 2, 3 may be separated from one another according to a transverse direction Y along the entire extension of the cutting edges 22, 32.

If, theoretically, in any pair of blades, even if they are joined at the lower part thereof, there is a separation, since all materials have a certain elasticity, according to the invention, the separation has a component of translation, meaning that the separation of the blades is allowed, and in the absence of complementary stop parts, and as can be seen in the figures, in any of the embodiments of the invention, continuing to push the conductor beyond the lower end (lower in consideration of the figures) would result in the cable being released.

As can be seen, considering the first embodiment, inserting a cable W in the connector 1 of the invention has the effect in that, as the cable is inserted, the depth of the insertion increases, and the lever arm is reduced as it is lowered. If the blades 2, 3 were parallel, the force would be reduced as the cable moved away from the rotation axes of the arms 5, 6.

This distancing is produced in the three embodiments of the invention, and in the third, although the section is constant, the rigidity of the arms will be reduced upon reaching the outgoing ends of the blade (the outgoing ends of the blades are those opposite to the incoming ends, which are contiguous with the sections for centering and inserting the cable W).

However, by having the blades as claimed, as the cable is inserted it causes a greater separation of the blades, thereby compensating the distancing with respect to the rotation axes of the elastic articulated arms. This effect is achieved providing the edges with an inclination, but by making them intertwined and overlapping (according to their projection), the effects of reducing the pressure (due to the distancing from the rotation axes) may be achieved, and the increase in pressure (due to the slope of the edges) may be compensated.

A person skilled in the art would achieve the progression of the desired pressure by playing with the arrangement of the rotation axes of the arms, which must never be close to the outgoing cutting area (as happens with the majority of the connectors in the state of the art), and with the slope of the blades and the separation thereof at the level of the inlet. It is worth noting that these two last parameters determine the crosspoint of the cutting edges, which in the illustrated embodiments is located in the middle of the edges.

Figure 12:
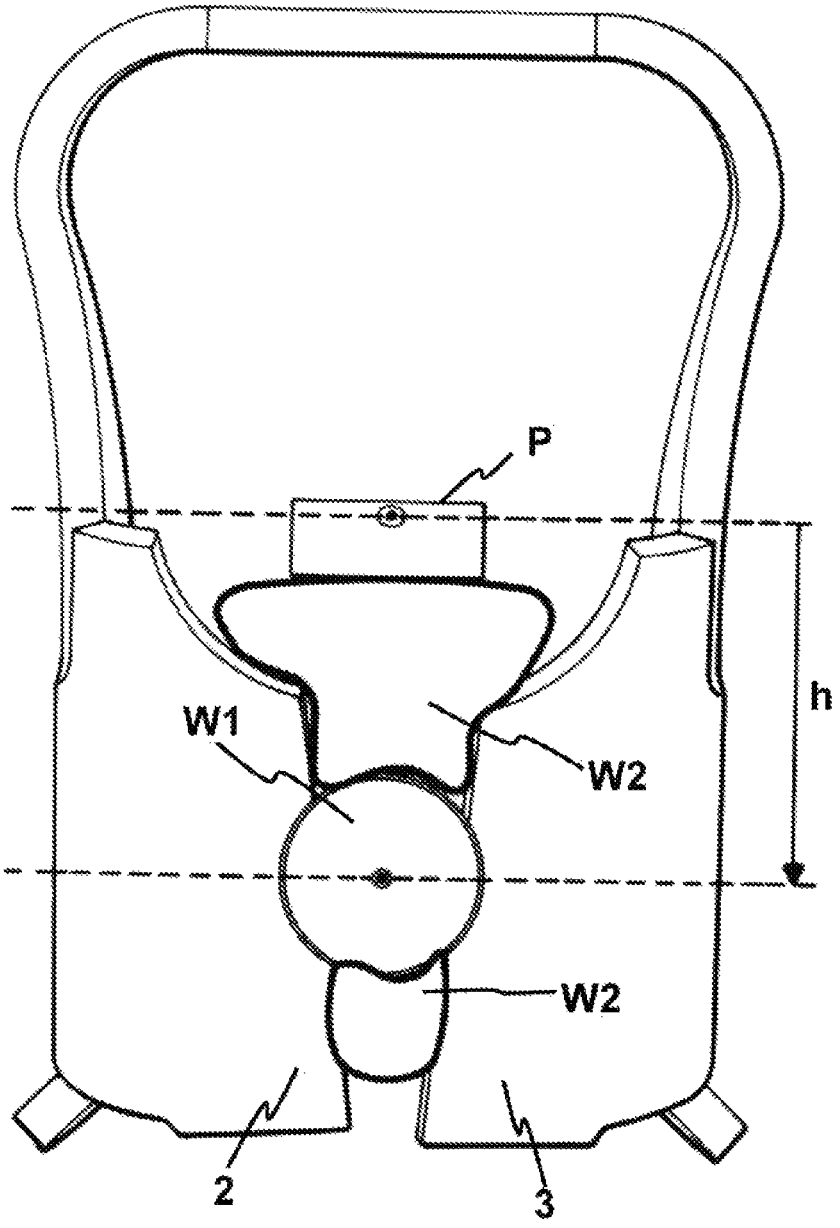

Put in another way, the connector 1 has intertwined blades 2, 3, creating a triangular space as the distance between the blades is progressively reduced from the inlet to the point where the cable is occluded (the point located at the depth (h) in FIG. 12). The advantage is that the force of the cut at the entry is reduced, but as it advances or goes deeper, there is enough force to reach any cable core. In the closest known state of the art, the blades 2, 3 have a more or less constant distance, and at the inlet a recess is made such that the inlet force is less but the force of the rest of the way is constant and does not always allow the core to be reached (obviously depending on the size thereof), which is the technical problem solved by the present invention.

The connector of the invention is designed to be integrated in a plastic casing provided with complementary elements such as the connection to other conductor elements, inlets for cables (W) and especially a pressure element or lever P which allows the cable to be pressed for its insertion thereof between the blades 2, 3 and also to serve as a stable lock for the cable which has already been peeled and connected to the blades in the connected position, as shown in FIG. 12.

Therefore, the cable is locked from above by the lever P, and from below by the greater pressure due to the inclination of the blades. The lock on the lower part may also be guaranteed by means of lateral stops, outside the connector, facing the arms 5, 6. In any case, it has been shown that the lock provided by the slope of the blades 2, 3 provides a better response from the cables to traction according to the direction Z.

As shown in FIGS. 1 to 4, according to a first embodiment, the base 4 and the arms 5, 6 jointly define a section. In this case, the bottom of the U is the base 4, and the blades 2, 3 are joined to each arm 5, 6 at the upper part of the lateral edges of the arms 5, 6 and perpendicular to the same, such that a volume V for receiving a cable W is defined between the base 4, the arms 5, 6 and a lower edge of the blades 2, 3, as seen in FIG. 11.

Figure 11:
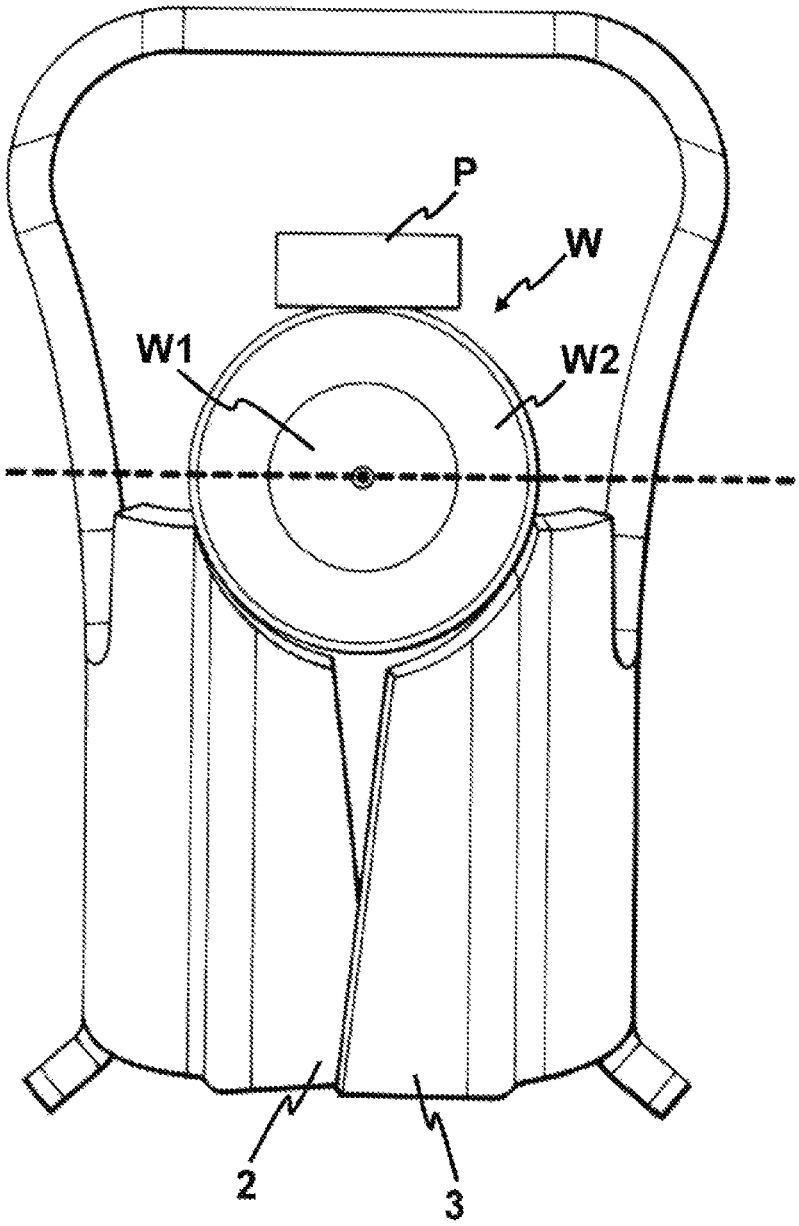
FIGS. 11 and 12 show the first and last moments of the cable connection process in the case of the first embodiment.

As can be seen in FIGS. 1 and 11, the sections 21, 31 for centering and insertion have a contour of a circular arc, which will be designed according to the cables to be inserted.

Figure 2:
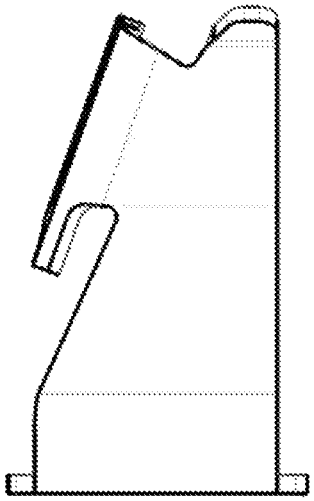
Figure 3:
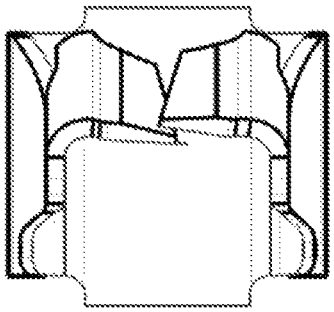
Figure 4:
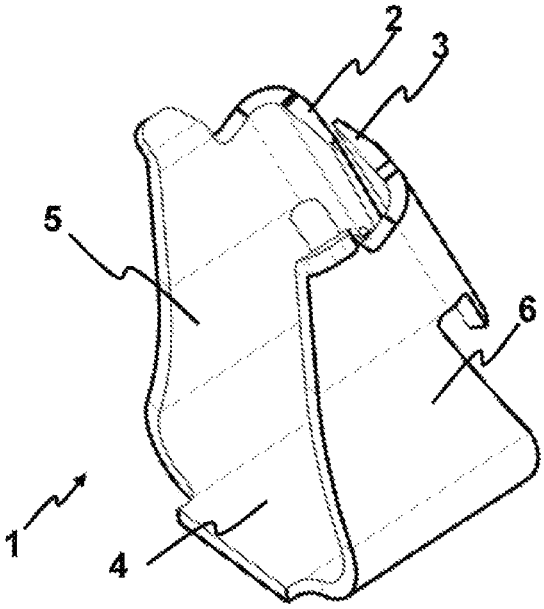

As can be seen in FIG. 2, the blades 2, 3 form an angle comprised between 70° and 80° with the direction X. This embodiment of the connector may be designed with two pairs of blades. This double version would consist of making a mirror image of the elevation in FIG. 2 on the right thereof according to a vertical axis, such that the base 4 would be common. Therefore, the blades would have an inverted angle.

FIGS. 11 and 12 illustrate the insertion and cutting process. As can be seen in FIG. 11, the cable W is first supported, meaning the outer surface of the sleeve W2 supported on the sections 21, 31 for centering and insertion. Then, by means of a lever P, the cable is pressed and inserted to a depth (h) until the blades 2, 3 enter into contact with the core W1 of the cable, thereby establishing electric contact.

Figure 6:
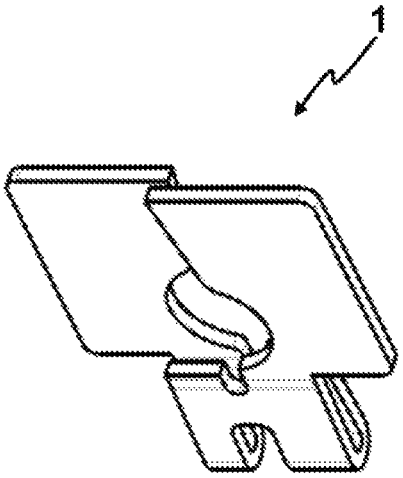
Figure 7:
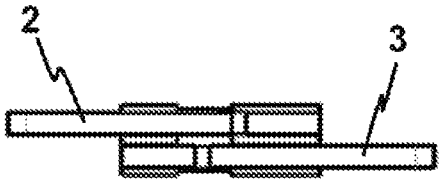

According to a second embodiment, illustrated in FIGS. 5 to 7, the base is a section of sheet bent into a U and the arms 5, 6 are extensions of the legs of the U, such that the arms are on parallel planes.

In this case, the blades 2, 3 are extensions of the arms 5, 6 and the base is on the part opposite to the end of the blades 2, 3 opposite the end joining to the sections 21, 31 for centering and insertion.

In this embodiment, the arms 5, 6 are cut according to a contour 51, 61 with the form of a circular arc on inner edges contiguous with the sections 21, 31 for centering and insertion of a cable W, such that an opening A for the insertion of a cable W is defined.

Figure 9:
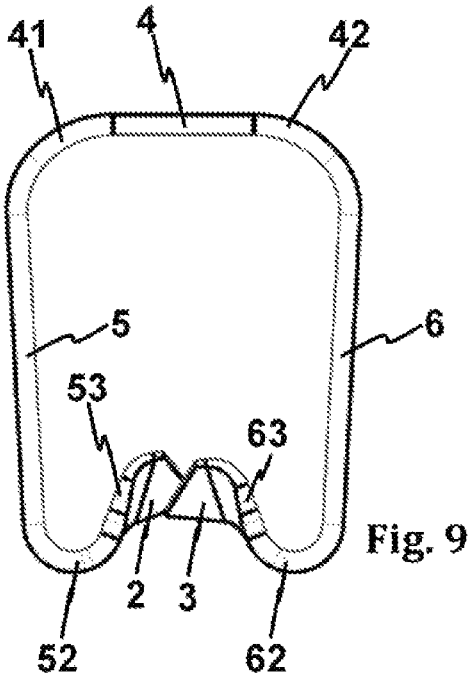
Figure 10:
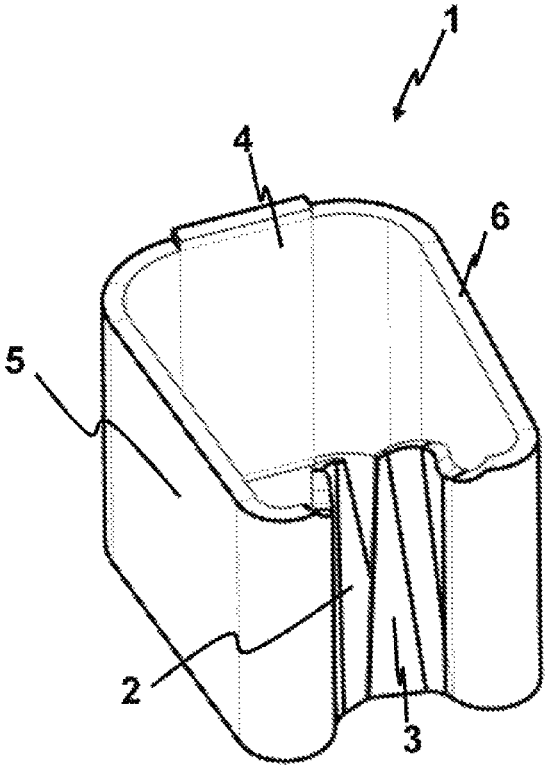

A third embodiment, illustrated in FIGS. 8 to 10, consists of a closed metal strip, having the form of a tubular section made up of the base 4, the arms 5, 6 and the blades 2, 3. In this case, the section which may be seen in FIG. 9 is made up of the base 4 articulated to the arms 5, 6 by means of two curved sections 41, 42, the other two ends of the arms 5, 6 made up of semicircular sections 52, 62 followed by two curved sections 53, 63 which end at the blades 2, 3.

In the first and second embodiments, the rotation axes of the arms are below the blades, considering FIGS. 1 and 5, meaning that they are after the sections 21, 31 for centering and insertion, but on the end opposite to the cutting direction of the cable. Indeed, in these cases the blades pivot on both axes which would be located at the level of the base 4 and would be axes that are perpendicular to the axis represented, meaning to an axis in the direction Z of FIGS. 1 and 5. In other words, in these embodiments, the movements of the blades 2, 3 are rotations in opposite directions, but since the axes are far enough apart, the effect is that of translation between the blades, meaning that they move with respect to one another.

In turn, in the embodiment in FIGS. 8 to 10, the rotation axes of the arms, which could be considered as located in the proximity of the corners 41, 42 and perpendicular to the plane of representation, considering FIG. 9, have a movement essentially of translation between the blades 2, 3.

In this text, the word "comprises" and its variants, such as "comprising", should not be understood in an exclusive sense, i.e. they do not exclude the possibility of that which is described including other elements, steps, etc.

Also, the invention is not limited to the specific embodiments described herein, but rather encompasses the variations that one skilled in the art could make (e.g. in terms of choice of materials, dimensions, components, design, etc.), within the scope of what may be deduced from the claims.

The invention claimed is:

1. An insulation-displacement connector comprising:

two cutting and connecting blades, each one provided with:

a section for centering and inserting a cable; and a cutting edge which extends from the section for centering and inserting the cable, a base; and an arm for joining each blade to the base, thereby defining:

an insertion direction between the blades;

a transverse direction, perpendicular to the insertion direction and which goes from one blade to another;

a frontal direction, perpendicular to the insertion and transverse directions, wherein in the absence of stress caused by the insertion of the cable between the blades, the cutting edges are inclined with respect to the insertion direction and throughout the entire extension of the edges, the projections of the cutting edges on a plane defined by the insertion and transverse directions intersecting at an intermediate point of the cutting edges, and the cutting and connecting blades not being joined together at an end of the blades opposite to the joining end with the sections for centering and insertion, but instead being joined to the joining arms such that the blades may be separated from one another according to the transverse direction along the entire extension of the cutting edges.

2. The connector according to claim 1, which is a punched and bent metal sheet.

3. The connector according to any of claim 1, in which the base and the arms jointly define a U section, wherein the bottom of the U is the base, the blades being joined to arms at the upper part of the lateral edges of the arms and perpendicular to the same, such that a volume for receiving the cable is defined between the base, the arms and a lower edge of the blades.

4. The connector according to claim 3, wherein the sections for centering and insertion have a contour of a circular arc.

5. The connector according to claim 3, wherein the blades and the base form an angle comprised between 70° and 80°.

6. The connector according to claim 1, wherein the base is a section of sheet bent in a U shape, the arms being extensions of the legs of the U, such that the arms are on parallel planes, the blades being extensions of the arms, the base being on the part opposite to the end of the blades opposite to the end joining to the section for centering and insertion.

7. The connector according to claim 6, wherein the arms are cut according to a contour with the form of a circular arc on inner edges contiguous to the sections for centering and inserting the cable, such that an opening for the insertion of the cable is defined.

8. The connector according to claim 1, which comprises a closed metal strip, having the form of a tubular section made up of the base, the arms and the blades.

9. The connector according to claim 8, the section of which is made up of the base articulated to the arms by means of two curved sections, the other two ends of the arms being made up of both semicircular sections followed by two curved sections which end at the blades.

* * * * *